United States Patent [19]

Matthews

[11] 4,421,520

[45] Dec. 20, 1983

[54] REDUCING THE TENDENCY OF DRIED COAL TO SPONTANEOUSLY IGNITE

[75] Inventor: J. David Matthews, Denver, Colo.

[73] Assignee: Atlantic Richfield Company, Los Angeles, Calif.

[21] Appl. No.: 333,146

[22] Filed: Dec. 21, 1981

[51] Int. Cl.[3] ..... C10L 5/24; C10L 5/32

[52] U.S. Cl. ..... 44/6; 44/1 G; 427/212

[58] Field of Search ..... 44/6, 1 R, 1 G, 2; 427/212

[56] References Cited

U.S. PATENT DOCUMENTS

| | | | |
|---|---|---|---|
| 1,245,358 | 8/1928 | Haddock | 44/6 X |
| 2,138,825 | 12/1938 | Allen | 44/6 X |
| 2,222,945 | 11/1940 | Groll, Jr. et al. | 44/6 |
| 2,278,413 | 4/1942 | Campbell | 44/6 |
| 2,854,347 | 9/1958 | Booth et al. | 44/6 X |
| 4,331,445 | 5/1982 | Burns | 44/6 |

*Primary Examiner*—Carl F. Dees

*Attorney, Agent, or Firm*—M. David Folzenlogen

[57] ABSTRACT

Mined, crushed, coal particles are dried and then contacted with a water-base dispersion or emulsion of latex paint type solids. The latex paint type solids form an elastic film that reduces the tendency of the dried coal to spontaneously ignite.

6 Claims, 3 Drawing Figures

REDUCING THE TENDENCY OF DRIED COAL TO SPONTANEOUSLY IGNITE

BACKGROUND OF THE INVENTION

This invention relates to improved methods for producing a dried particulate coal fuel having a reduced tendency to spontaneously ignite. More particularly, dried coal is contacted with a water-base dispersion or emulsion of latex paint type solids.

In many instances, coal as mined contains undesirably high quantities of water for transportation and use as a fuel. This problem is common to all coals although it is less severe in high grade coals, such as anthracite and bituminous coals. Attempts to dry crushed mined coals before shipment or storage have been inhibited by the tendency of such coals after drying to undergo spontaneous ignition and combustion in storage, transit or the like. As a result, a continuing effort has been directed to the development of improved methods whereby coals, especially low grade coals, such as sub-bituminous, lignite, and brown coals can be more than merely surface dried and threafter safely transported, stored, and used as fuels.

SUMMARY OF THE INVENTION

Dried crushed mined coal particles are sprayed with a water-base dispersion or emulsion of a small amount of latex paint type solids, hereinafter defined. The latex paint type solids form an elastic film on the dried coal particles and thereby reduce its tendency to spontaneously ignite. The dispersion or emulsion is easy to apply at ordinary temperatures, and is relatively nonflammable and non-toxic, and has very little unpleasant odor. The dispersion is readily formed on site from dry or concentrated chemicals, thereby, reducing shipping, storing and handling costs. The process is especially useful to gas dried sub-bituminous, lignite and brown coals having a moisture content of less than 10 to 15% by weight.

DETAILED DESCRIPTION OF THE INVENTION

Figure 1:
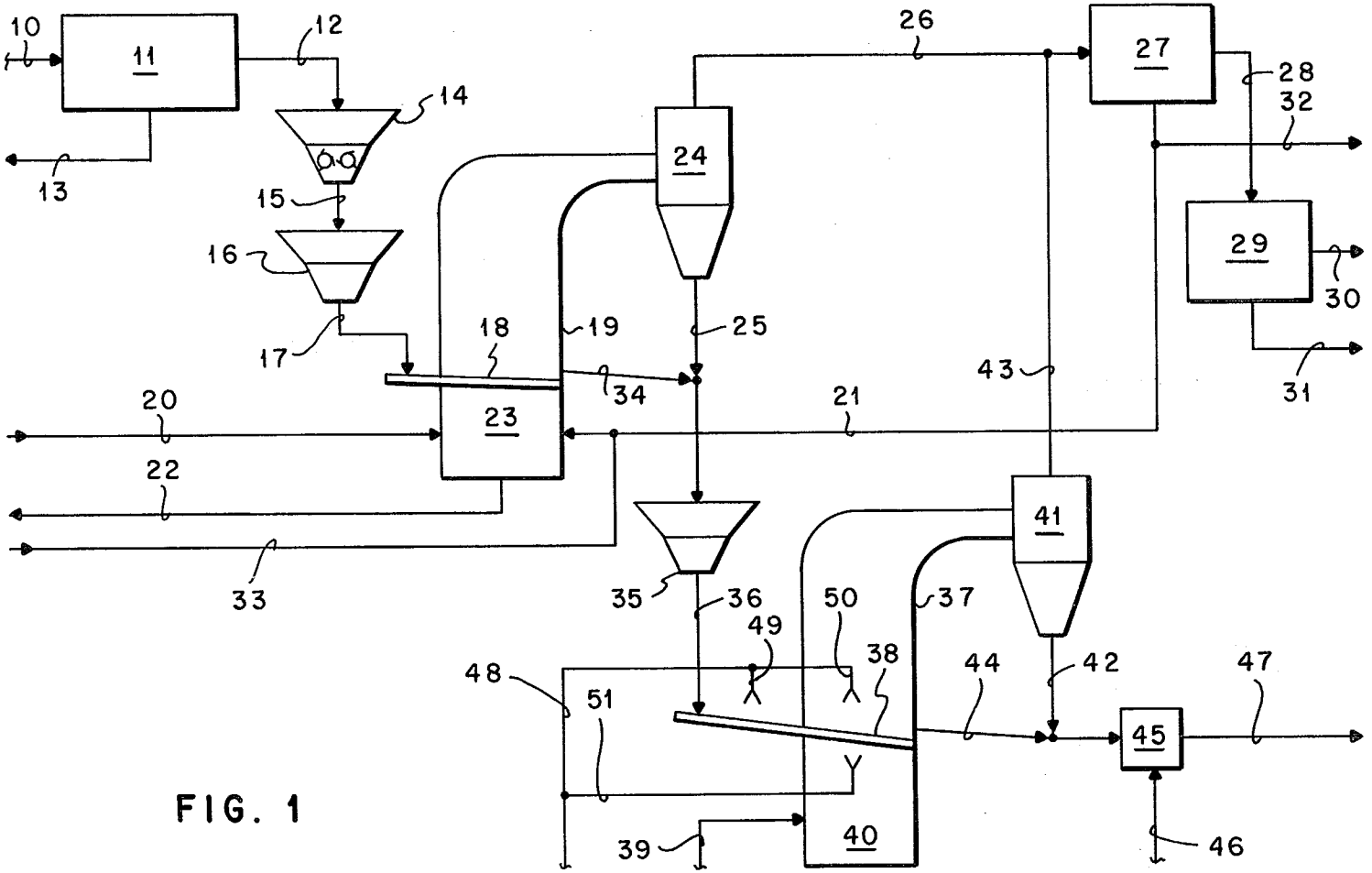
FIG. 1 is a schematic diagram of a coal drying process to which the method of this invention may be applied.

This invention is an improved method of reducing the tendency of dried coal to spontaneously ignite. Coals may be dried to remove surface water or deep dried to remove interstitial water and thereby increase the heating (BTU) value of the coal. In this description, dried coal is coal that has been dried to remove some of the interstitial water and the moisture content of a dried coal is measured in accordance with the procedures set forth in ASTM D3173-73, entitled "Standard Test Method for Moisture in the Analysis Sample of Coal and Coke," published in the 1978 Annual Book of ASTM Standards, Part 26. The method of this invention is applicable to all forms of dried coal, especially deep dried coals; but is especially useful for dried low grade coals, such as sub-bituminous, lignite and brown coals.

In the method, dried coal particles are contacted with a water-base dispersion comprised of water and latex paint type solids. These types of solids form a coherent elastic film on the dried coal particles and reduce its tendency to spontaneously ignite.

The drawings illustrate one of the many types of processes to which this invention is applicable. In the drawings, reference will be made to lines generally rather than attempting to distinguish between lines as conduits, conveyors or the like.

Accordingly, a run of mine coal stream is charged through a line 10 to a coal cleaning or preparation plant 11 from which a coal stream is recovered through a line 14 with a waste stream comprising gangues and the like being recovered and passed to discharge through a line 13. In some instances, it may not be necessary to pass the run of mine coal to a coal cleaning or processing plant prior to charging it to the process of the present invention, although in many instances, such may be desirable. The coal stream recovered from preparation plant 11 through line 12 is passed to a crusher 14 where it is crushed to a suitable size and passed through a line 15 to a hopper 16. While a size may be less than about two inches, i.e. two inches by zero may be suitable in some instances, typically a size will be about one inch by zero or about three-quarters inch by zero will be found more suitable. The particulate coal in hopper 16 is fed through a line 17 to a moving grate, slotted grate, rotating drum, revolving screen, spinning grill, expanded bed, fluidized bed, semi-fluidized bed, or the like 18 in a dryer 19. In dryer 19, the coal moves or is removed at a rate determined by the desired residence time in dryer 19. A hot gas is passed upwardly through the coal in dryer 19 to dry the coal. In the drawing, the hot gas is produced by injecting air through a line 20 to combust a stream of coal fines injected through a line 21. The combustion of the coal fines generates hot gas at a temperature suitable for drying the coal. As will be obvious to those skilled in the art, the temperature can be varied by diluting the air with a non-combustible gas, by the use of alternate fuels, by the use of oxygen enriched streams or the like. Clearly, alternate fuels, i.e. liquid or gaseous fuels could be used instead of or in addition to the finely divided coal, although it is contemplated that in most instances, a stream of finely divided coal will be found most suitable for use as a fuel to produce the heated gas. Ash is recovered from dryer 19 through a line 22. A combustion zone 23 may be appropriately located in dryer 19 to permit the production of the hot gas, although it will be readily understood that the combustion zone or hot gas could be produced outside dryer 19. The exhaust gas from dryer 19 is passed to a cyclone 24 where finely divided solids, typically larger than about 100 Tyler mesh, are separated from the exhaust gas and recovered through a line 25. The exhaust gas, which may still contain solids smaller than about 100 Tyler mesh, is passed through a line 26 to a fine solids recovery section 27 where finely divided solids, which will typically consist primarily of finely divided coal are recovered through line 21 with all or a portion of the finely divided coal being recycled back to combustion zone 23. The purified exhaust gas from fine solid recovery section 27 is passed through a line 28 to a gas cleanup section 29 where sulfur compounds, light hydrocarbon compounds, and the like are removed from the exhaust gas in line 28, as necessary to produce a flue gas which can be discharged to the atmosphere. The purified gas is discharged via a line 30 with the contaminates recovered from the exhaust gas being recovered through a line 31 and optionally passed to a flare, a wet scrubber or the like. The handling of the process gas discharge is not considered to constitute a part of the present invention, and the cleanup of this gaseous stream will not be discussed further. The fine coal stream recovered through line 21 may in some instances constitute more coal fines than are usable in combustion zone 23. In such instances, a fine coal product can be recovered through a line 32. In other instances, the amount of coal fines recovered may not be sufficient to provide the desired temperature in the hot gas used in dryer 19. In such instances, additional coal fines may be added through a line 33.

The dried coal product recovered from dryer 19 is recovered via a line 34 and combined with the solids recovered from cyclone 24 through line 25 and passed to a hopper 35 from which dried coal is fed via a line 36 to a cooler 37. Cooler 37 includes a moving grate, slotted grate, rotating drum, revolving screen, spinning grill, or the like 38 on which the dried coal is supported as it passes through cooler 37. In cooler 37, a cool gas is introduced through line 39 into a distribution chamber 40 beneath the hot coal and is passed upwardly through the dried coal to cool the dried coal. The exhaust gas from cooler 37 is passed to cyclone 41 where solids generally larger than about 100 Tyler mesh are separated and recovered through a line 42 with the exhaust gas being passed through a line 43 to fine solids recovery section 27. Optionally, the gas recovered through line 43 could be passed to combustion chamber 23 for use in producing the hot gas required in dryer 19. The cooled dried coal is recovered through a line 44 and combined with the solids recovered from cyclone 41 to produce a dried coal product. The tendency of such dried low rank coals to spontaneously ignite is inhibited greatly by cooling such coals after drying.

In the improved method of this invention, the dried coal product is contacted with a special suitable deactivating fluid in a mixing zone 45. The special deactivating fluid is introduced through a line 46 and intimately mixed with the cooled dried coal in mixing zone 45 to produce a coal product, recovered through line 47, which has a reduced tendency to spontaneously ignite under normal storage and transportation conditions.

As shown, dried coal is mixed with deactivating fluid after cooling; but it should be understood that the dried coal can be mixed with the special deactivating fluid at higher temperatures before cooling although it is believed that normally the mixing is preferably at temperatures no higher than about 200° F. (93° C.).

While cool gas alone may be used in cooler 37, improved cooling is accomplished in cooler 37 by the use of water injection as set forth in U.S. patent application, Ser. No. 333,145 entitled "Improved Process For Cooling Particulate Coal" by Bernard F. Bonnecaze filed of even data herewith and owned by a common assignee. The water is added through a line 48 and a spray system 49 immediately prior to passing the dried coal into cooler 37 or through a spray system 50 which adds the water to the dried coal immediately after injecting the coal into cooler 37. Either or both types of systems may be used. The amount of water added is only that amount required to achieve the desired cooling of the dried coal by evaporation. The water is sprayed onto the coal. The spray is controlled to an amount such that the added water is substantially completely evaporated from the coal prior to discharge of the cooled dried coal via line 44. In many areas of the country, relatively dry air is available for use in such cooling applications. For instance, in Wyoming, a typical summer air condition is about 90° F. (32° C.) dry bulb temperature and about 65° F. (18° C.) wet bulb temperature. Such air is very suitable for use in the cooler as described. While substantially any cooling gas could be used, the gas used will normally be air. Air is injected in an amount sufficient to fluidize or semi-fluidize the dried coal moving along grate 38 and in an amount sufficient to prevent the leaking of water through grate 38. The flow is further controlled to a level such that the velocity above the coal on grate 82 is insufficient to entrain any liquid water in the exhaust stream flowing to cyclone 41. Such determinations are within the skill of those in the art and need not be discussed in detail since the flow rates will vary depending upon the amount of cooling required.

In a further variation, water may in some instances be introduced as a fine mist beneath grate 38 via a spray system 51 and carried into the coal moving along grate 38 with the cooling gas. In such instances, similar considerations apply, and only that amount of water is added which is required to accomplish the desired temperature reduction in the coal on grate 38.

When relatively dry air is available, it may be desirable in some instances to use evaporative cooling outside cooler 37 to produce a cooled air stream for use in cooling the dried coal in cooler 37.

In the operation of dryer 19, the discharge temperature of the dried coal is typically from about 130° to about 250° F. (54° to 121° C.) and is preferably from about 190° to about 220° F. (88° to 104° C.). The residence time is chosen to accomplish the desired amount of drying and is readily determined experimentally by those skilled in the art based upon the particular type of coal used and the like. For instance, when drying subbituminous coal, an initial water content of about 30 weight percent is common. Desirably, such coals are dried to a water content of less than about 15 weight percent and preferably from about 5 to about 10 weight percent. Lignite coals often contain in the vicinity of about 40 weight percent water and are desirably dried to less than about 20 weight percent water with a range from about 5 to about 20 weight percent water being preferred. Brown coals may contain as much as, or in some instances even more than about 65 weight percent water. In many instances, it may be necessary to treat such brown coals by other physical separation processes to remove portions of the water before drying is attempted. In any event, these coals are desirably dried to a water content of less than about 30 weight percent and preferably to about less than 5 to 20 weight percent. The determination of the residence time for such coals in dryer 19 may be determined experimentally by those skilled in the art for each particular coal. The determination of a suitable residence time is dependent upon many variables and will not be discussed in detail.

The discharge temperature of the dried coal from dryer 19 is readily controlled by varying the amount of coal fines and air burned so that the resulting hot gaseous mixture after combustion is at the desired temperature. Temperatures should be controlled to avoid initiating spontaneous combustion of the coal. Suitable temperatures for many coals are from 250° to about 950° F. (104° to 570° C.).

In the operation of cooler 37, the temperature of the dried coal charged to cooler 37 in the process shown is typically that of the dried coal discharged from dryer 19 less process heat losses. The temperature of the dried coal is desirably reduced in cooler 80 to a temperature below about 100° F. (38° C.) and preferably below about 80° F. (27° C.). The residence time, amount of cooling air, cooling water and the like may be determined experimentally by those skilled in the art. Such determinations are dependent upon the amount of cooling required and the like. As well known to those skilled in the art, after drying, coals are very susceptible to spontaneous ignition and combustion upon storage, in transit or the like. While such is the case, it is highly desirable that coals be available for use more widely than is possible at the present. The original moisture content of some coals results in excessive shipping costs, due at least in large measure to the excessive amount of water which is subject to freight charges and similarly results in lower heating values for the coals since a substantial portion of the coal is water rather than combustible carbonaceous material. The lower heating value results in a limited use for the coals since many furnaces are not adapted to burn such lower BTU coals. By contrast, when the water content is reduced, the heating value is raised since a much larger portion of the coal then comprises combustible carbonaceous material. As a result, it is highly desirable that some coals be dried prior to shipment and that the tendency of dried coals to spontaneously ignite be reduced.

Accordingly, in the method of this invention, sometime after the dried coal particles are removed from dryer 19, the coal particles are contacted with a special deactivating dispersion fluid. The deactivating dispersion may be sprayed on the particles before, during or after the hot coal solids are cooled. This deactivating dispersion fluid is an elastic film forming water-base dispersion comprised of finely divided or milled latex paint type solids dispersed or emulsified with water. This includes emulsion polymerization. Surfactants, protective colloids and similar paint additives may be added to help spread and stabilize the solids and to increase the adherence of the solids. Based on that data, it appears that dispersions with concentrations as low as 0.25% by weight of latex paint type solids will be successful. The maximum concentration will depend on costs; but it is believed that the maximum concentration will not exceed 60% by weight of latex paint type solids. The dispersion may be used in any suitable quantity; but tests indicate that quantities between 0.5 to 2.0 gallons of dispersion per 2000 pounds of dried coal will usually be adequate. Suitable solids are vinyl acetate, polyvinyl chloride, vinyl acetate/acrylic copolymers, styrene-butadiene, acrylic latex or resins, natural gums or resins, tall oil, neoprene, rubber and polyesters. If the quantity of solids in relation to the coal is significant, halogen containing solids will not be used; but for the most part, the amount of solids is practically negligible in comparison to the weight of the dried coal.

Figure 2:
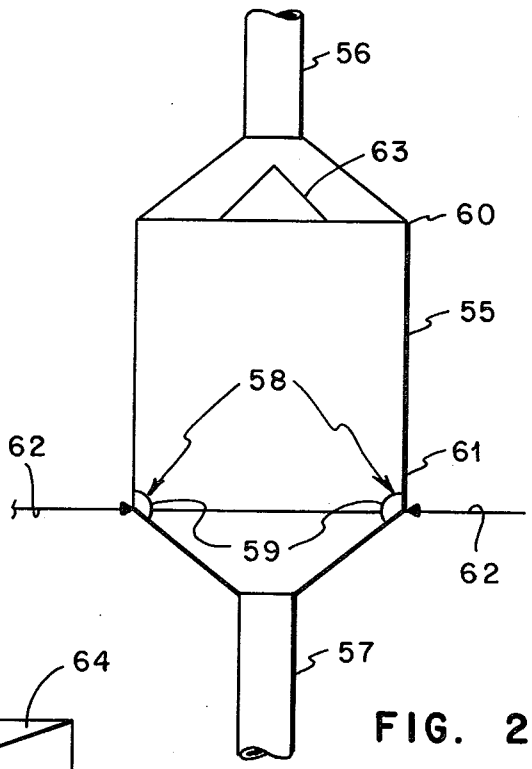
FIG. 2 is a schematic diagram of an apparatus for use in contacting particulate dried coal with the special deactivating dispersion of this invention.

The intimate mixing of the dried coal and deactivating fluid is readily accomplished in a vessel such as shown in FIG. 2. Such a vessel and a method for intimately contacting particulate coal and a deactivating fluid are set forth in U.S. patent application, Ser. No. 333,144 entitled "Method and Apparatus for Contacting Particulate Coal and a Deactivating Fluid" by James L. Skinner and J. David Matthews filed of even date herewith and owned by a common assignee. In FIG. 2, the dried coal product or oxidized dried coal is charged to a contacting vessel 55 through a line 56 with the contacted coal being recovered through a line or discharge 57. In contact vessel 55, the deactivating fluid is maintained as a finely divided mist by spraying the deactivating fluid into vessel 55 through spray mist injection means 58 which, as shown in FIG. 2, are nozzles 59. Clearly, vessel 55 can be of a variety of configurations, and any reasonable number of mist nozzles 59 can be used. It is, however, necessary that the residence time between the upper end 60 of contacting vessel 55 and the lower end 61 of vessel 55 be sufficient that the coal is intimately contacted with the deactivating fluid as it passes through vessel 55. Deactivating fluid is injected into vessel 55 through lines 62 which supply nozzles 59. Optionally a diverter 63 may be positioned to disrupt the flow of the coal to facilitate contact with the deactivating fluid.

Figure 3:
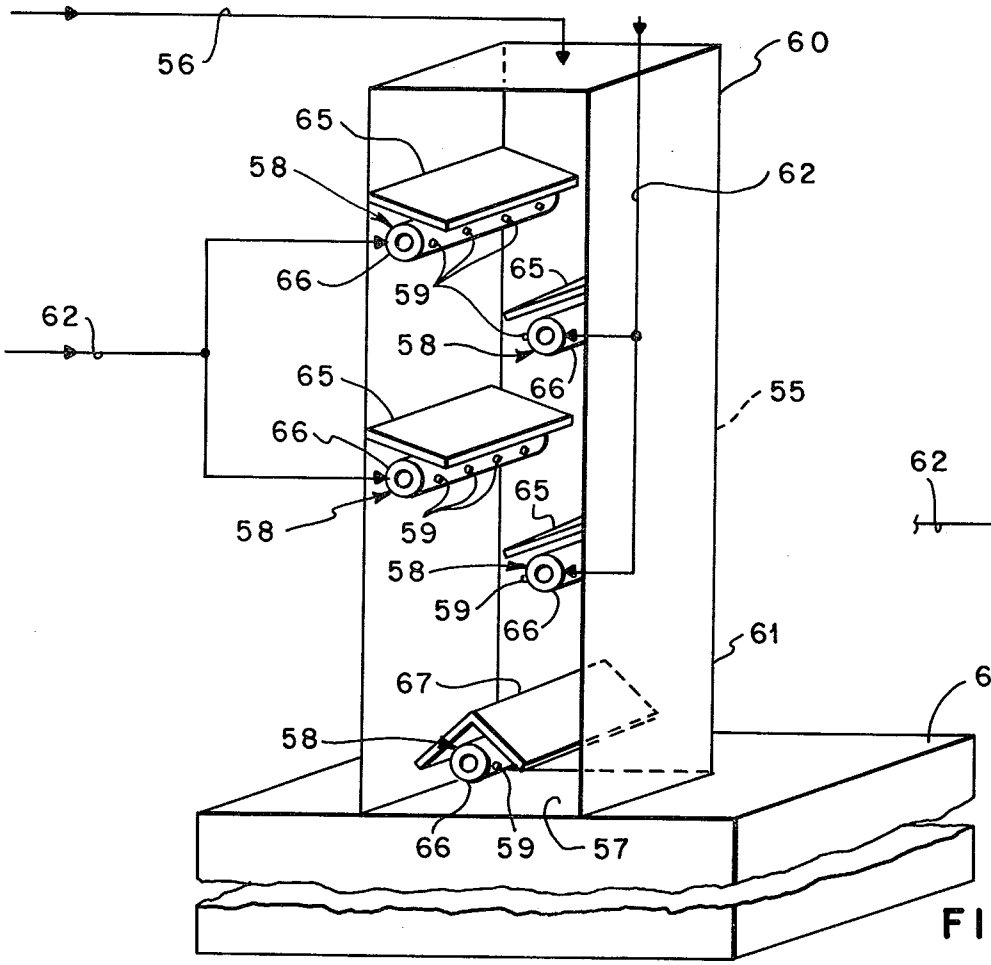
FIG. 3 is a schematic diagram of a further embodiment of an apparatus for use in contacting particulate dried coal with the special deactivating dispersion.

A further embodiment of a suitable contacting vessel is shown in FIG. 3. The contacting vessel shown in FIG. 3 is positioned on a storage hopper 64 and includes on its inner walls a plurality of projections 65, which serve to break up the smooth fall of particulate coal solids through vessel 55 thereby facilitating intimate contact of the particulate solids with the deactivating fluid mist present in vessel 55. Projections 65 may be of substantially any effective shape or size. Mist injection means 58 as shown in FIG. 3 comprise tubes 66 positioned beneath projections 65. Tubes 66 include a plurality of mist injection nozzles 59. Further, a deflector 69 is provided near lower end 61 of vessel 55 to further deflect the stream of particulate coal solids as they are discharged from vessel 55. A tube 66 including mist nozzles 59 is positioned beneath deflector 67.

In the operation of the vessels shown in FIGS. 2 and 3, a particulate coal stream is introduced into the upper portion of the vessels 55 and passes downwardly through vessel 55 by gravity flow in continuous contact with a finely divided mist of a suitable deactivating fluid. The residence time is highly variable depending upon the size of the stream passed through vessel 55 the presence or absence of projections in vessel 55 and the like. The contact time and amount of mist are adjusted to obtain a desired quantity of deactivating fluid in intimate mixture with the coal.

The deactivating dispersion of this invention may be preceded by an additional step for reducing the tendency of the dried coal to spontaneously ignite. A controlled oxidation step may be supplied after the coal drying operation and prior to cooling the dried coal. A method and apparatus for oxidizing such coal is set forth in U.S. patent application, Ser. No. 333,143 entitled "Method and Apparatus for Oxidizing Dried Low Rank Coal" by Donald K. Wunderlich filed of even date herewith and owned by a common assignee.

The foregoing description of the conditions and variables of the process illustrates a preferred method of conducting the process and how the deactivating dispersion coacts with the drying stage to accomplish the advantages and objectives herein set forth.

Reasonable variations and modifications are practical with the scope of this disclosure without departing from the spirit and scope of the claims of this invention. For example, the selection of the particular process will be dependent to a large extent upon the particular coal feed stock used. It may also be dependent on the amount of duct suppression needed. Another variable which may affect the choice of the process for a particular coal is the risk involved upon spontaneous ignition. For instance, it may be desirable to over-treat dried coal products which are to be shipped by sea or the like in view of the substantially greater risk of damage upon spontaneous ignition that would be the case for coals which are to be stacked near a coal-consuming facility. A multitude of considerations will affect the particular process chosen; however, it is believed that the particular combination of steps set forth will be found effective in the treatment of substantially any coal especially low rank coals, to produce a dried fuel product which has a reduced tendency toward spontaneous ignition.

The embodiments of the invention in which an exclusive property or privilege is claimed are defined as follows:

1. In a method for producing a dried particulate coal fuel having a reduced tendency to spontaneously ignite wherein crushed mined coal is heated in a drying zone with a hot gas to vaporize water from the coal and dry the coal to a moisture content of less than about 20 percent by weight of water and wherein the dried coal is removed from said drying zone, the improvement comprising contacting and intimately mixing said removed dried coal particles with a water-base dispersion comprised of water and latex paint type solids, whereby an elastic film is formed on said dried coal particles.

2. The method of claim 1 wherein said crushed mined coal is selected from the group consisting of sub-bituminous, lignite, brown coals and combinations thereof.

3. The method of claim 2 wherein said crushed mined coal is heated to a temperature from about 130° F. to about 250° F. in said coal drying zone.

4. The method of claim 1 wherein said removed dried coal is contacted with about 0.5 gallon to about 2 gallons of said dispersion per short U.S. ton of coal and said dispersion contains at least 0.25% by wt. of said latex paint type solids.

5. The method of claim 1 wherein said removed dried coal is cooled to a temperature below 100° F. before said removed dried coal is contacted with said dispersion.

6. The method of claim 1 wherein the coal is dried to a moisture content of between 5 and 20 percent by weight of water.

* * * * *